US012022897B2

(12) United States Patent
Menchaca

(10) Patent No.: US 12,022,897 B2
(45) Date of Patent: Jul. 2, 2024

(54) FACEMASK

(71) Applicant: Renee Lucille Menchaca, Glenview, IL (US)

(72) Inventor: Renee Lucille Menchaca, Glenview, IL (US)

( * ) Notice: Subject to any disclaimer, the term of this patent is extended or adjusted under 35 U.S.C. 154(b) by 827 days.

(21) Appl. No.: 17/068,699

(22) Filed: Oct. 12, 2020

(65) Prior Publication Data

US 2022/0110379 A1 Apr. 14, 2022

(51) Int. Cl.
*A41D 13/11* (2006.01)

(52) U.S. Cl.
CPC ..... *A41D 13/1107* (2013.01); *A41D 13/1161* (2013.01)

(58) Field of Classification Search
CPC ..... A41D 13/1107; A41D 13/1115; A41D 13/1123; A41D 13/1138; A41D 13/1146; A41D 13/1153; A41D 13/1161; A41D 13/1169; A41D 13/1176; A41D 13/1184; A41D 13/1192; A41D 13/00; A41D 13/01; A41D 13/11; A41D 27/08; A61M 16/065; A61M 16/0605; A61M 16/0611; A61M 16/0616; A61M 16/0622; A61M 16/0627; A61M 16/0633; A61M 16/0638; A61M 16/0644; A61M 16/0655; A61M 16/0666; A61M 16/0672; A61M 16/0677; A61M 16/0683; A61M 16/0688; A61M 16/0694; A61M 16/0808; A61M 2016/0661; A63F 2011/0016; A63F 5/04; A63F 5/048; A63F 11/0011; G09F 11/02; G09F 11/04; G09F 11/23; G09F 11/025; G09F 11/232; G09F 2011/0009; G09F 2011/0045; G09F 2011/0054; G09F 2011/0063; G09F 3/12; G09F 3/207
See application file for complete search history.

(56) References Cited

U.S. PATENT DOCUMENTS 752,114 A * 2/1904 Sennett ..... A41D 13/11 128/863
784,077 A * 3/1905 Smith ..... A44C 3/001 273/153 R
835,828 A * 11/1906 Meyrowitz ..... A61F 9/028 2/437

(Continued)

OTHER PUBLICATIONS

Andersen BM. Protection of Upper Respiratory Tract, Mouth and Eyes. Prevention and Control of Infections in Hospitals. 2018;129-146. Published Sep. 25, 2018. doi: 10.1007/978-3-319-99921-0_13 (Year: 2018).*

(Continued)

*Primary Examiner* — Samchuan C Yao
*Assistant Examiner* — Nicholas B. Engel
(74) *Attorney, Agent, or Firm* — Alejandro Menchaca

(57) ABSTRACT

A facemask is disclosed. The facemask comprising an outer facemask layer and an inner facemask layer, which are fixed to each other to define a facemask interior. The outer facemask layer has an opening. A disk is rotatably fixed within the facemask interior such that a first portion of the disk is viewable through the opening in the outer facemask layer and such that the disk may be rotated so that a second portion of the disk may be viewable through the opening in the outer facemask layer. A fastener rotatably fixes the disk within the facemask interior.

19 Claims, 5 Drawing Sheets

(56) References Cited

U.S. PATENT DOCUMENTS 1,292,096 A * 1/1919 Schwartz ..... A41D 13/1161 128/206.16
1,426,487 A * 8/1922 Laux ..... A44C 3/001 40/1.5
1,805,633 A * 5/1931 Moran ..... A61F 9/02 2/437
1,842,675 A * 1/1932 Kannenberg ..... A61F 9/024 359/889
2,270,535 A * 1/1942 Young ..... G02B 5/3025 359/488.01
2,968,396 A * 1/1961 Pratt ..... B65D 75/5855 53/461
3,333,586 A * 8/1967 Bellis ..... A61F 9/022 604/308
3,590,498 A * 7/1971 Landzerg ..... G09B 3/06 434/327
3,601,031 A * 8/1971 Abel ..... F24F 3/167 55/467
4,129,122 A * 12/1978 Dout ..... A61G 10/02 600/21
4,153,952 A * 5/1979 Dussich ..... A61F 9/062 359/490.02
4,396,259 A * 8/1983 Miller ..... G02C 5/001 351/44
4,581,986 A * 4/1986 Conklin ..... A61G 10/005 52/2.14
5,423,441 A * 6/1995 Conti ..... B65D 41/48 215/256
5,628,308 A * 5/1997 Harges, Jr. ..... A41D 13/1153 128/206.28
6,016,573 A * 1/2000 Olson ..... A41D 27/20 2/247
2006/0212996 A1* 9/2006 McGrath ..... A41D 13/1161 2/207
2010/0187297 A1* 7/2010 Hickox ..... A63B 71/0672 235/1 B

OTHER PUBLICATIONS

Bowatte G, Tham R, Perret JL, et al. Air Pollution and Otitis Media in Children: A Systematic Review of Literature. Int J Environ Res Public Health. 2018; 15(2):257. Published Feb. 3, 2018. doi: 10.3390/ijerph15020257 (Year: 2018).*

Corning, PolarCoat: A Breakthrough Technology in the Polarized Field, 2013; https://web.archive.org/web/20160506214528/https://www.corning.com/worldwide/en/products/advanced-optics/product-materials/specialty-glass-and-glass-ceramics/ophthalmic-glass/polar-coat.html (Year: 2013).*

Luzerne Optical, Polarized Lenses, 2011, available at https://www.luzerneoptical.com/polarized-lenses.html (Year: 2011).* https://www.snapfish.com/custom-face-mask-with-filter; the image of this website submitted with this form was captured on Nov. 3, 2020.

* cited by examiner

FACEMASK

BACKGROUND OF THE INVENTION

The present disclosure generally relates to facemasks worn to protect the wearer from airborne particles, pathogens, and the like.

BRIEF SUMMARY OF THE INVENTION

According to one embodiment, a facemask has an outer facemask layer and an inner facemask layer defining a facemask interior. The outer facemask layer has an opening. A disk is rotatably fixed within the facemask interior such that a portion of the disk is visible through the opening in the outer facemask layer.

According to one embodiment, a facemask has an outer facemask layer and an inner facemask layer defining a facemask interior. The facemask has a periphery. The outer facemask layer has an opening in its lower portion. A disk is rotatably fixed within the facemask interior by a fastener such that a portion of the disk is visible through the opening in the lower portion of the outer facemask layer. The fastener comprises a first fastener portion, a second fastener portion, and a link locking the first fastener portion to the second fastener portion, and the fastener rotatably fixes the disk to the outer facemask layer, the inner facemask layer, the periphery, or any combination of the outer facemask layer, the inner facemask layer, and the periphery. The disk may comprise a position indicator so that the wearer may determine which portion of the disk is being exhibited and may rotate the disk to a different desired portion for exhibit.

It is to be understood that both the foregoing general description and the following detailed description describe various embodiments and are intended to provide an overview or framework for understanding the nature and character of the claimed subject matter. The accompanying drawings are included to depict embodiments but are not intended to limit the scope of the present disclosure.

DETAILED DESCRIPTION OF THE INVENTION

Figure 1:
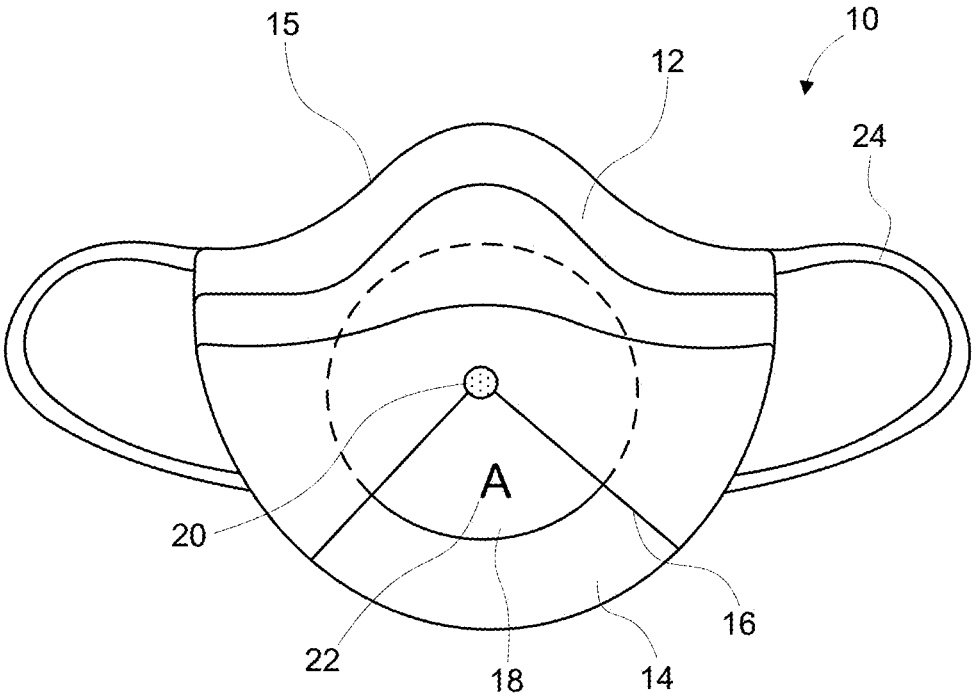
FIG. 1 depicts a front view of one embodiment of a facemask.

Reference will now be made in detail to embodiments of a facemask, examples of which are illustrated in the accompanying drawings. Whenever possible, the same reference numerals will be used throughout the drawings to refer to the same or like parts.

FIG. 1 depicts a front view of one embodiment of a facemask 10. Facemask 10 has an outer facemask layer 12 and an inner facemask layer 14. Outer facemask layer 12 is fixed in a conventional manner to inner facemask layer 14. A typical manner of fixing outer facemask layer 12 to inner facemask layer 14 is by sewing the two layers together. In fixing outer facemask layer 12 to inner facemask layer 14, there is created a facemask interior. Facemask 10 also has a facemask periphery 15, which may result from fixing, as by sewing, outer facemask layer 12 to inner facemask layer 14, or otherwise. Inner facemask layer 14 may be one of a plurality of facemask layers other than outer facemask layer 12.

Outer facemask layer 12 has an opening 16 in its lower portion. In the embodiment of FIG. 1, opening 16 defines the lower extremity of outer facemask layer 12.

Disk 18 is positioned in the facemask interior and held in place by fastener 20. In the embodiment of FIG. 1, fastener 20 sits behind outer facemask layer 12 and is not visible from a front view of facemask 10. Fastener 20, described in more detail below connection with FIG. 5, may fix disk 18 to any of outer facemask layer 12, inner facemask layer 14, and/or periphery 15. Fastener 20 rotatably fixes disk 18 in place so that disk 18 may be rotated. A first portion 22 of disk 18 can be viewed in opening 16 of outer facemask layer 12. The wearer may rotate disk 18 so that a different portion of disk 18 can be viewed in opening 16 of outer facemask layer 12.

Facemask 10 may be provided with straps 24 to fix facemask 10 to the wearer's head.

Figure 2:
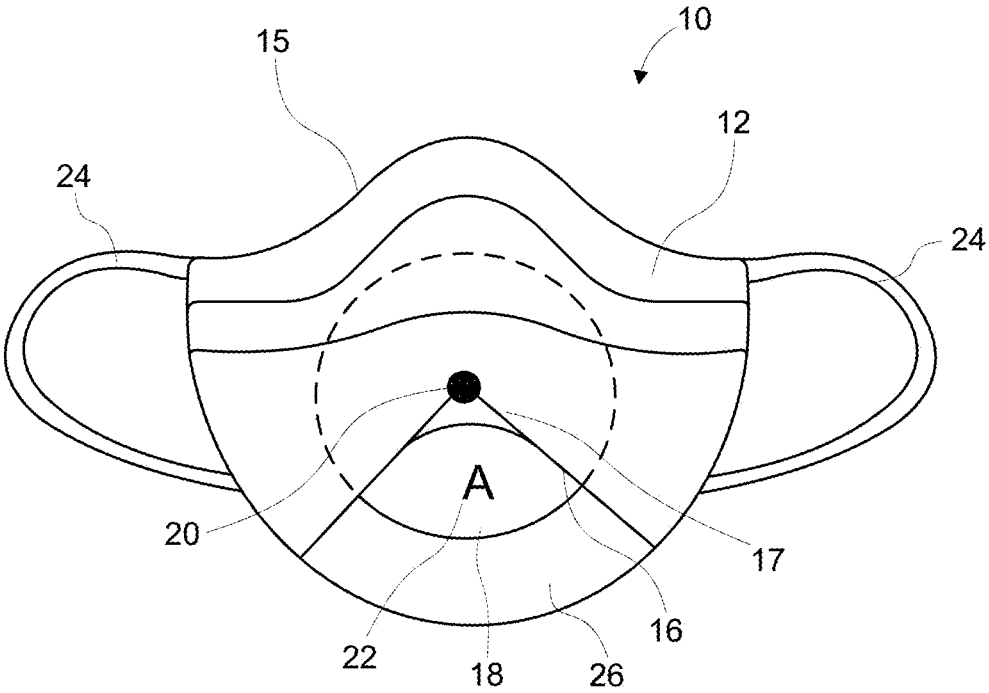
FIG. 2 depicts a front view of one embodiment of a facemask.

FIG. 2 depicts a front view of one embodiment of a facemask 10. Facemask 10 includes an outer facemask layer 12 fixed to an inner facemask layer 14 to define a facemask interior, Facemask 10 also has a facemask periphery 15, which may result from fixing, as by sewing, outer facemask layer 12 to inner facemask layer 14, or otherwise. Outer facemask layer 12 has in its lower portion an opening 16. Outer facemask layer 12 also has in its lower portion a lower band 26 positioned below opening 16, In the embodiment of FIG. 2 lower band 26 of outer facemask layer 12 defines the lower extremity of outer facemask layer 12.

Disk 18 is positioned in the facemask interior and held in place by fastener 20, In the embodiment of FIG. 2, fastener 20 sits on the outside of outer facemask layer 12 and is visible from a front view of facemask 10. A first portion 22 of disk 18 is visible through opening 16 of outer facemask layer 12. Opening 16 is shown with alternative opening profiles 17, one of which is rounded and one of which provides a sharp angle as in the embodiment of FIG. 1.

Figure 3:
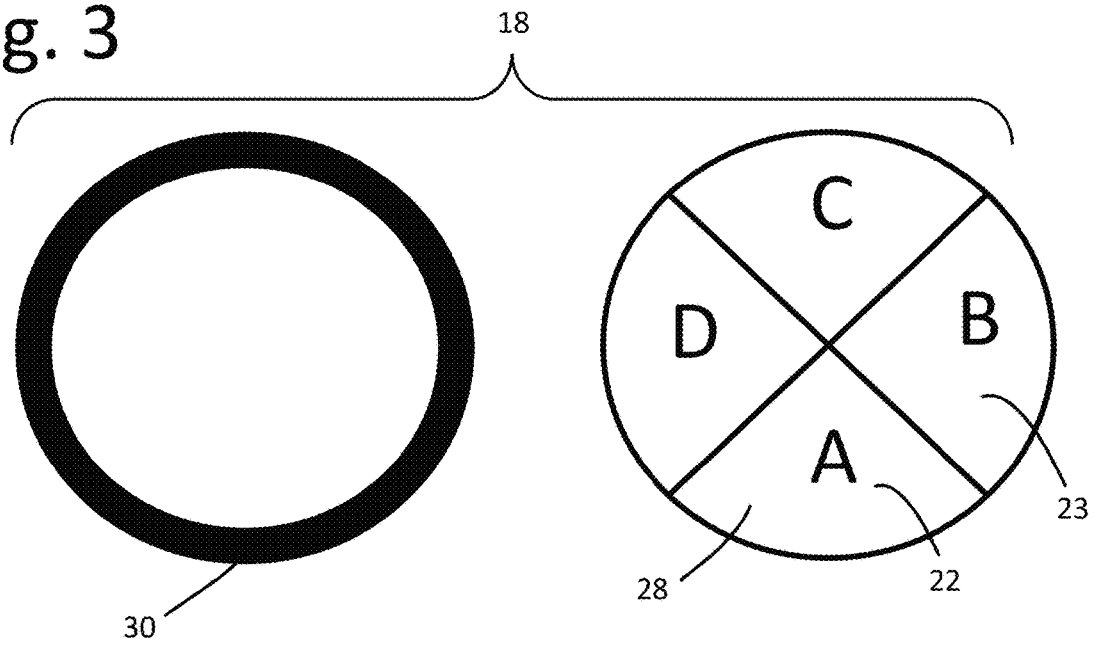
FIG. 3 depicts a front view of a disk, including a display and a supporting frame.

FIG. 3 depicts a front view of a disk 18, including a display 28 and supporting frame 30. Disk 18 maybe of any configuration as long as it may be rotated within the facemask interior, Preferably, disk 18 is circular, Disk 18 may be of a unitary construction, for example of a semi-rigid plastic construction. Preferably, however, disk 18 is constructed of breathable material such as fabric display 28 fixed to a supporting frame 30. Display 28 includes at least a first portion 22 and a second portion 23. As described above in connection with FIGS. 1 and 2, the wearer may select which portion of disk 18 shall be exhibited. Display 28 may include two, three, four, or more portions with different content to be shown through opening 16 in outer facemask layer 12. Preferably, display 28 includes three or four portions for exhibiting.

Supporting frame 30 may be of a construction sufficiently rigid to provide support to display 28 while lending itself to use in any particular facemask 10 configuration. For example, supporting frame 30 may be constructed of a semi-rigid plastic or a malleable and/or resilient wire.

Figure 4A:
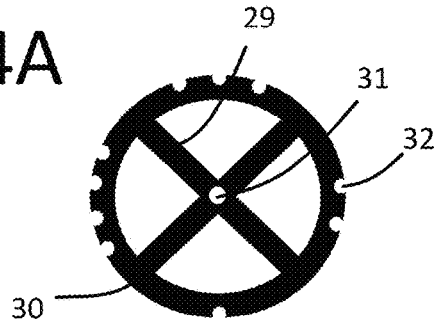
FIG. 4A depicts a front view of an embodiment of a supporting frame with position indicators.

FIG. 4 depicts a front view of two alternative embodiments of a supporting frame 30 and position indicators 32. FIG. 4A shows supporting frame 30 with internal framing 29. Internal framing 29 provides additional rigid characteristics to supporting frame 30. Supporting frame 30 also includes hole 31. Hole 31 is configured to receive or provide a passage for fastener 20. Supporting frame 30 includes position indicators 32. Each segment of supporting frame 30 corresponding to a different portion of display 28 will possess a different position indicator scheme so that the wearer can differentiate one portion of display 28 from a different portion of display 28. The embodiment of FIG. 4A shows each different segment of supporting frame 30 with a different number of position indicators 32.

Figure 4B:
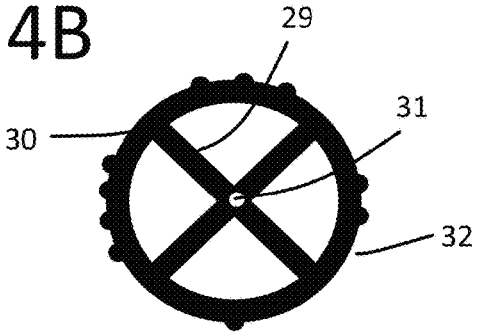
FIG. 4B depicts a front view of an embodiment of a supporting frame with position indicators.

The embodiment of FIG. 4B is similar to that of FIG. 4A except that it depicts a different position indicator scheme. The present disclosure contemplates any other type or style of position indicator, such as, for example, different texture, bumps, indentations, protrusions, or the like provided to differentiate position. As noted above, the preferred configuration of disk 18 is circular, but different segments of frame 30 may have different numbers of straight subsegments as a position indicator scheme.

Figure 5:
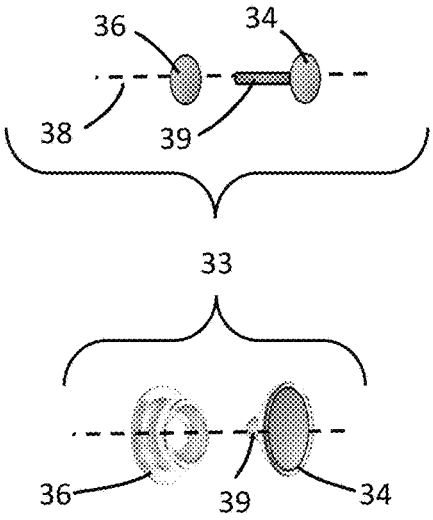
FIG. 5 depicts two embodiments of a fastener in perspective exploded view.

FIG. 5 depicts two embodiments of a fastener 33 in exploded view. The present disclosure contemplates any type of conventional fastener. FIG. 5 illustrates two typical conventional fasteners 33 having a two- or three-part construction—a first fastener portion 34, a second fashioner portion 36, and a link 39 align to cooperate along fastening axis 38. Link 39 may optionally be integral with one of first fastener portion 34 or second fastener portion 36. A typical fastener 33 that may be employed is a double cap rivet or a cap and stud. Alternatively, fastener 33 may cooperate with hole 31 of internal framing 29 of supporting frame 30 to fix disk 18 in the interior of facemask 10. For example, first fastener portion 34 may have an integral link 39 that cooperates with hole 31 to fix disk 18 within the facemask interior. In this configuration, internal framing 29 operates as second fastener portion 36.

Link 39 locks first fastener portion 34 to second fastener portion 36. In one embodiment of the present disclosure, link 39 may releasably lock first fastener portion 34 to second fastener portion 36 such that the wearer may disassemble fastener 20, remove disk 18, and install a new disk 18 with different images for exhibiting. It should be appreciated that the terms lock and locking are not limited to a permanently joined configuration but include a releasably joined configuration as well.

Figure 6:
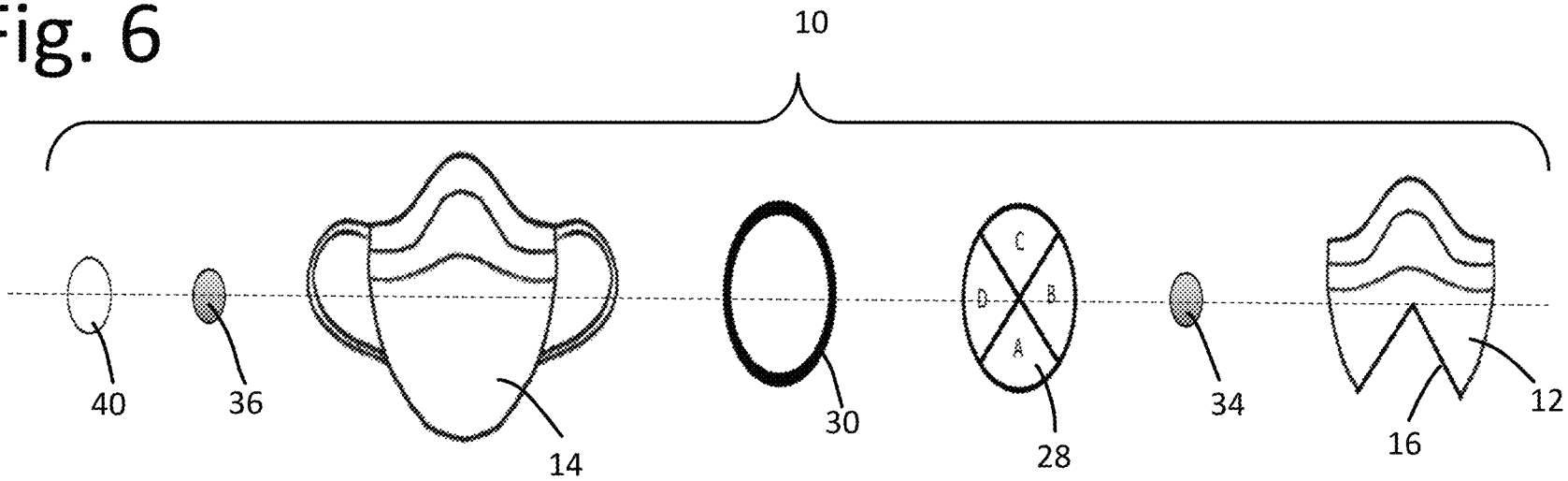
FIG. 6 is a perspective exploded view of a facemask.

FIG. 6 is a perspective exploded view of a facemask 10, FIG. 6 depicts one possible construction of facemask 10, Facemask 10 includes an outer facemask layer 12 which may be joined with inner facemask layer 14 to define a facemask interior to accommodate display 28 and supporting frame 30 of disk 18. Additionally, first fastener portion 34 is fitted inside of the facemask interior so that first fastener portion 34 is not visible from the front view of facemask 10. Second fastener portion 36 may be positioned behind inner facemask layer 14. In this configuration, inside fastener cover 40 is employed to cover second fastener portion 36 in order to prevent irritation or discomfort to the wearer, Inside fastener cover 40 may be fabric or other suitable material.

Figure 7:
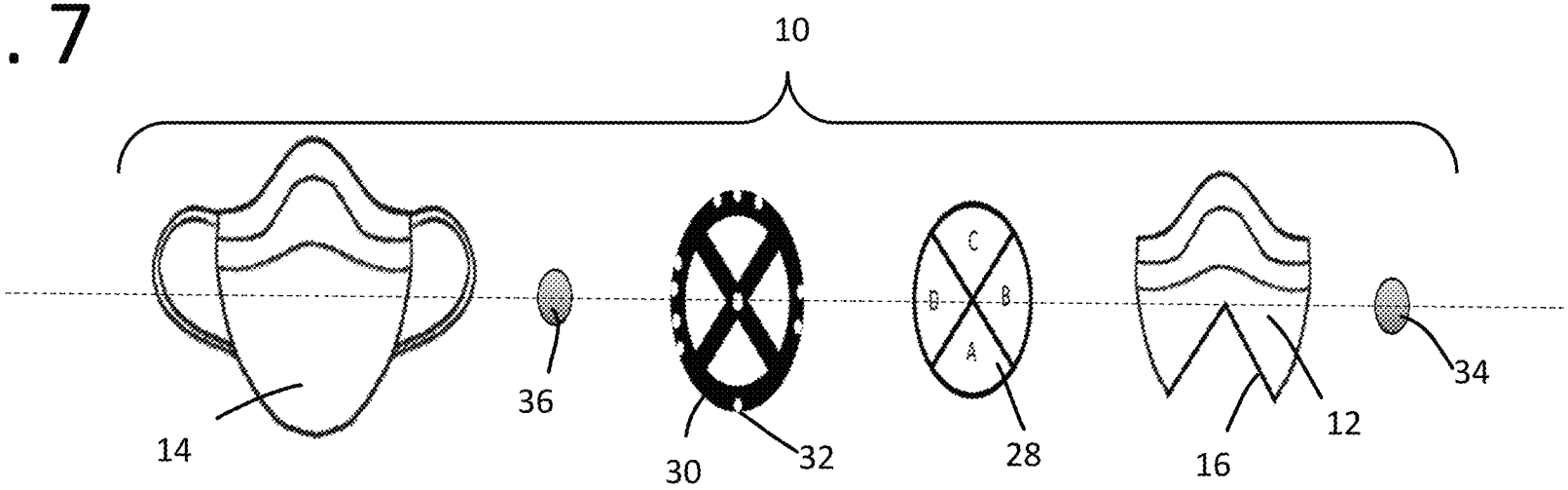
FIG. 7 is a perspective exploded view of a facemask.

FIG. 7 is a perspective exploded view of a facemask 10. FIG. 7 depicts one possible construction of facemask 10. Facemask 10 includes an outer facemask layer 12 which may be joined with inner facemask layer 14 to define a facemask interior to accommodate display 28 and supporting frame 30 of disk 18. In the configuration of FIG. 7, first fastener portion 34 is positioned on the outside of facemask 10 such that it will be visible in a front view of facemask 10. Second fastener portion 36 may be fitted within the facemask interior between disk 18 and inner facemask layer 14. Alternatively, supporting frame 30 may operate as second fastener portion 36.

Figure 8A:
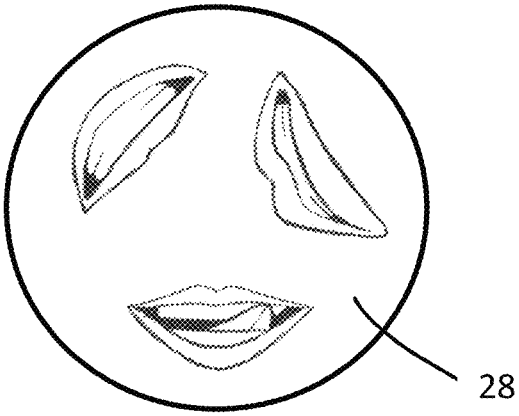
FIG. 8A depicts an embodiment of a display.
Figure 8B:
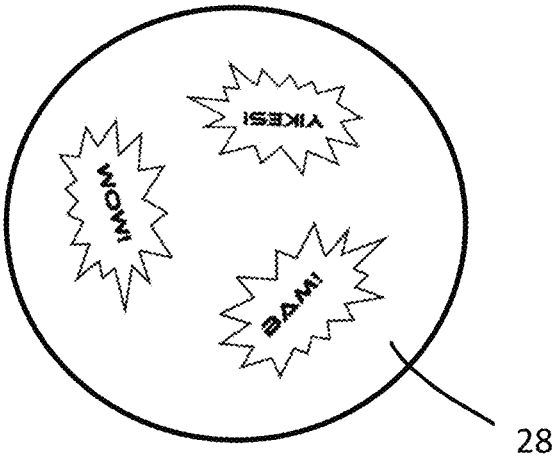
FIG. 8B depicts an embodiment of a display.
Figure 8C:
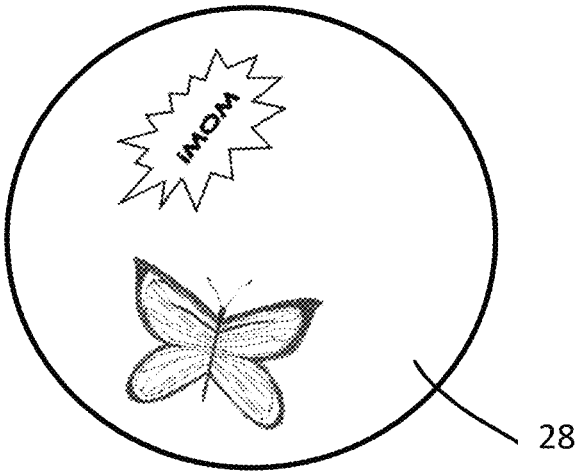
FIG. 8C depicts an embodiment of a display.
Figure 9:
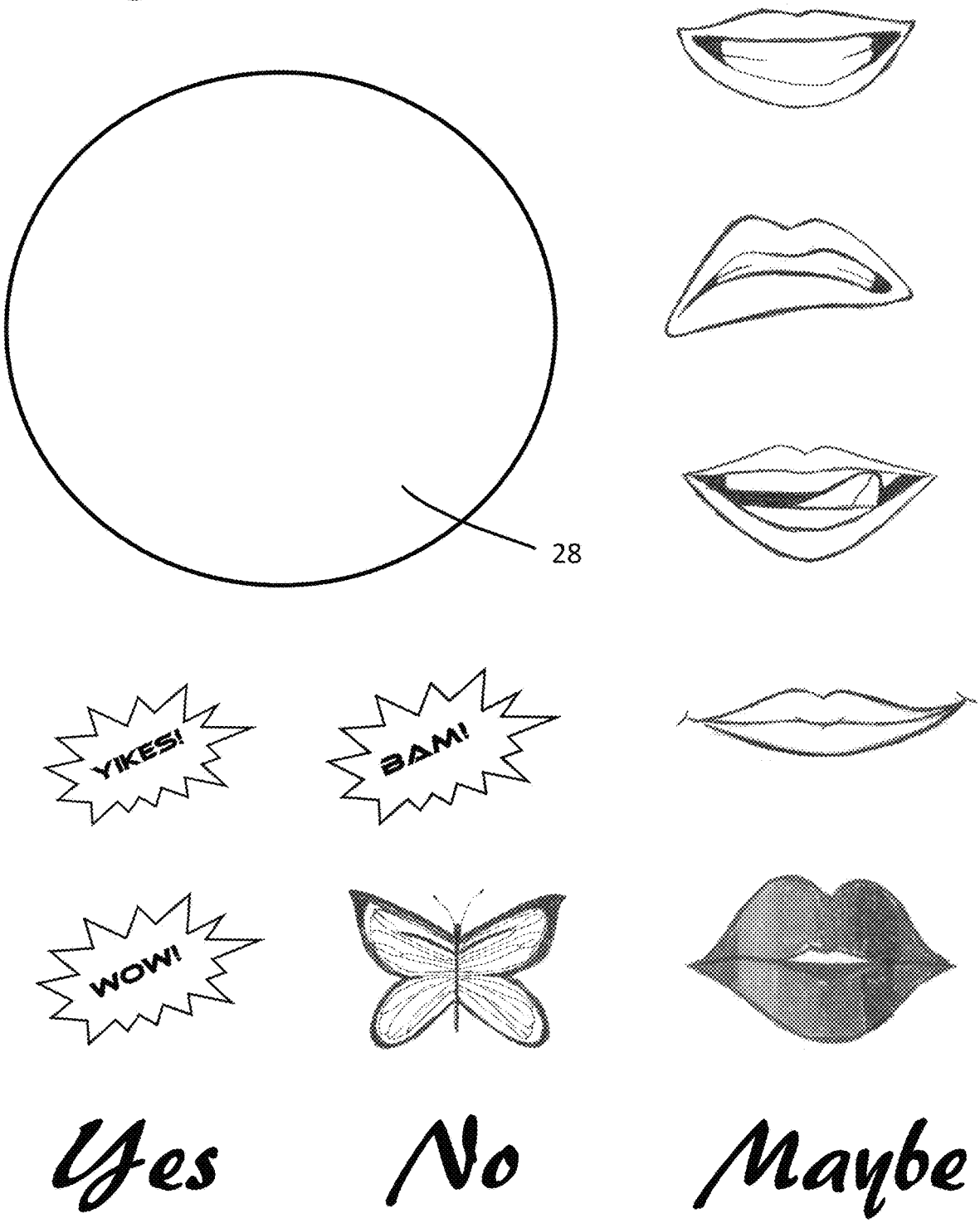
FIG. 9 depicts an embodiment of a display.

FIG. 8A, FIG. 8B, and FIG. 8C depict three embodiments of a display 28. The display embodiments shown in FIGS. 8A, 8B, and 8C may be used in connection with a fastener 33 that provides a permanently locking configuration or a fastener 33 that provides a releasably locking configuration. It will be appreciated that a fastener 33 that provides a releasably locking configuration lends itself to the use of more than one of the embodiments depicted in FIGS. 8A, 8B, and 8C. FIG. 8C includes one blank space that may be color coordinated with the outer facemask layer, FIG. 9 depicts one embodiment of display 28, Display 28 may be provided with or without images. Additional images may be made available so that the wearer can select and install his or her favorite images on a single display.

It will be apparent to those skilled in the art that various modifications and variations can be made to the embodiments described herein without departing from the spirit and scope of the claimed subject matter. For example, although the embodiments of the figures show opening 16 in a lower portion of outer facemask layer 12 on the front of facemask 10, opening 16 may also be on the left cheek side, the right cheek side, or an upper portion of facemask 10. Thus, it is intended that the specification cover the modifications and variations of the various embodiments described herein provided such modification and variations come within the scope of the appended claims and their equivalents. It should also be understood that spatial descriptors are employed for ease of description and are not intended to limit the scope of the disclosure. For example, the terms "lower" and "below" are relative and the disclosure is intended to describe facemasks in any spatial orientation that employ the teachings of the disclosure.

The invention claimed is:

1. A facemask comprising:

an outer facemask layer and a second facemask layer; the outer facemask layer having an opening, and the outer facemask layer fixed to the second facemask layer to define a facemask interior;

a disk rotatably fixed within the facemask interior such that a first portion of the disk is viewable through the opening in the outer facemask layer and such that the disk may be rotated so that a second portion of the disk may be viewable through the opening in the outer facemask layer; the disk being constructed of breathable material;

a fastener rotatably fixing the disk to the facemask within the facemask interior; and a plurality of straps for attaching the facemask to the head of the wearer.

2. The facemask of claim 1 wherein the outer facemask layer comprises a lower portion, the opening is in the lower portion, and the opening in the lower portion of the outer facemask layer defines a lower extremity of the outer facemask layer.

3. The facemask of claim 1 wherein the outer facemask layer further comprises a lower band positioned below the opening and wherein the lower band defines a lower extremity of the outer facemask layer.

4. The facemask of claim 1 wherein the outer facemask layer further comprises an upper band positioned above the opening and wherein the upper band defines an upper extremity of the outer facemask layer.

5. The facemask of claim 1 wherein the fastener rotatably fixes the disk to the outer facemask layer, the second facemask layer, or both.

6. The facemask of claim 5 wherein the fastener comprises a first fastener portion, a second fastener portion, and a link locking the first fastener portion to the second fastener portion.

7. The facemask of claim 6 wherein the outer facemask layer comprises a lower portion, the opening is in the lower portion, and the opening in the lower portion of the outer facemask layer defines a lower extremity of the outer facemask layer.

8. The facemask of claim 6 wherein the outer facemask layer further comprises a lower band positioned below the opening and wherein the lower band defines a lower extremity of the outer facemask layer.

9. The facemask of claim 1 wherein the facemask further comprises a periphery and the fastener rotatably fixes the disk to the outer facemask layer, the second facemask layer, the periphery, or any combination of the outer facemask layer, the second facemask layer, and the periphery.

10. The facemask of claim 9 wherein the fastener comprises a first fastener portion, a second fastener portion, and a link locking the first fastener portion to the second fastener portion.

11. The facemask of claim 10 wherein the outer facemask layer comprises a lower portion, the opening is in the lower portion, and the opening in the lower portion of the outer facemask layer defines a lower extremity of the outer facemask layer.

12. The facemask of claim 10 wherein the outer facemask layer further comprises a lower band positioned below the opening and wherein the lower band defines a lower extremity of the outer facemask layer.

13. The facemask of claim 1 wherein the disk comprises a display and a supporting frame, the display is fixed to the supporting frame.

14. The facemask of claim 11 wherein the disk comprises a display and a supporting frame, the display is fixed to the supporting frame.

15. The facemask of claim 1 wherein the disk comprises a position indicator.

16. The facemask of claim 13 wherein the disk comprises a position indicator.

17. A facemask comprising:

an outer facemask layer and a second facemask layer; the outer facemask layer having a lower portion with an opening in the lower portion, and the outer facemask layer fixed to the second facemask layer to define a facemask interior and a facemask periphery;

a disk rotatably fixed within the facemask interior such that a first portion of the disk is viewable through the opening in the lower portion of the outer facemask layer and such that the disk may be rotated so that a second portion of the disk may be viewable through the opening in the lower portion; the disk being constructed of breathable material;

a fastener rotatably fixing the disk within the facemask interior, wherein the fastener comprises a first fastener portion, a second fastener portion, and a link locking the first fastener portion to the second fastener portion, and the fastener rotatably fixes the disk to the outer facemask layer, the second facemask layer, the periphery, or any combination of the outer facemask layer, the second facemask layer, and the periphery; and a plurality of straps for attaching the facemask to the head of the wearer.

18. The facemask of claim 17 wherein the disk comprises a position indicator.

19. A facemask comprising:

an outer facemask layer and a second facemask layer; the outer facemask layer having a lower portion with an opening in the lower portion, the opening defining a lower extremity of the outer facemask layer, and the outer facemask layer fixed to the second facemask layer to define a facemask interior and a facemask periphery;

a disk rotatably fixed within the facemask interior such that a first portion of the disk is viewable through the opening in the lower portion of the outer facemask layer and such that the disk may be rotated so that a second portion of the disk may be viewable through the opening in the lower portion, the disk comprises a display and a supporting frame, the display fixed to the supporting frame, and wherein the disk comprises a position indicator; the disk being constructed of breathable material;

a fastener rotatably fixing the disk within the facemask interior, wherein the fastener comprises a first fastener portion, a second fastener portion, and a link locking the first fastener portion to the second fastener portion, and the fastener rotatably fixes the disk to the outer facemask layer, the second facemask layer, the periphery, or any combination of the outer facemask layer, the second facemask layer, and the periphery; and a plurality of straps for attaching the facemask to the head of the wearer.

* * * * *